US005091959A

United States Patent [19]

Sohn et al.

[11] Patent Number: 5,091,959

[45] Date of Patent: Feb. 25, 1992

[54] SPEAKER SYSTEM

[75] Inventors: Tong-Hong Sohn, Kongjak Apt. House A-1011, Yoido-Dong, Yongdungpo-Ku; Jeong-Hoon Yoon, both of Seoul, Rep. of Korea

[73] Assignee: Tong-Hoon Sohn, Seoul, Rep. of Korea

[21] Appl. No.: 598,539

[22] Filed: Oct. 16, 1990

[30] Foreign Application Priority Data

Oct. 16, 1989 [KR] Rep. of Korea ..... 89-14880

[51] Int. Cl.[5] ..... H04R 25/00

[52] U.S. Cl. ..... 381/165; 381/166

[58] Field of Search ..... 381/194, 165, 166, 167

[56] References Cited

U.S. PATENT DOCUMENTS

| | | | |
|---|---|---|---|
| 1,007,031 | 10/1911 | Jahnke | 381/165 |
| 1,900,623 | 3/1933 | Tewksbury | 381/165 |
| 2,616,984 | 11/1952 | Pare | 381/165 |
| 4,194,095 | 3/1980 | Poi et al. | 381/165 |

*Primary Examiner*—Forester W. Isen
*Assistant Examiner*—Jason Chan
*Attorney, Agent, or Firm*—Dvorak and Traub

[57] ABSTRACT

A sound speaker system has air chambers in a cylinder with a voice coil actuated vibrator and suitable inner wall speakers.

4 Claims, 6 Drawing Sheets

SPEAKER SYSTEM

FIELD OF THE INVENTION

This invention relates to a speaker system and more particularly to speaker system which displacement of a vibrator moving by piston through a voice signal is not affected by change of sound pressure; and which has improved transient phenomenon, distortion rate, and phase difference which are not compensated from the existing speaker system by providing with constant air pressure, mounting separately air tanks with high and low pressure.

BACKGROUND AND SUMMARY OF THE INVENTION

Sound defines vibration of air, i.e. change of small air pressure.

Speaker systems reproducing sound using such a principle have held, in general, most of the speaker system.

There are electric speakers which are classified with a cone type, a dome type and a horn type; ribbon shaped speakers which are typically used as a tweeter by driving entirely the vibrating plate different from said electric speaker; speakers which have operated by absorption and repulsion with electro static power disposing two electrodes in narrow space; and high clear speaker using piezo effects.

Further, when above listed speakers are classified according to the frequency, woofer as a speaker unit for only low sound, squawker or mid-range as a speaker unit for only mid sound and tweeter as a speaker unit for only high sound. In order to understood the present invention, characteristics for woofer, mid-range and tweeter will be reviewed basing the cone speaker which has widely and generally used and the prior arts problems will be considered.

FIG. 1 is shown a general structure of a cone type speaker. When sound signal is inputted on an input terminal(13), current runs on a voice coil(4) and a center pole yoke(1), a plate(2) and a magnet(3) are formed a magnetic circuit. Accordingly, cone(5) integrally formed with the voice coil(4) is moved by a piston above and below along the side of the center pole yoke(1) in response to said signal.

When the cone(5) is moved above, i.e., in case of advancement of 180° production of sound pressure is possible. However, when the cone(5) is moved below, that is, in case of backing of 180° production of sound pressure is impossible. In case of above movement of the cone(5), it is particles(air) having mass under the atomsphere of 1,013 mmBAR so that production of sound pressure by the cone(5) is possible.

However, in case of below movement of the cone(5), the air volume is reduced and a hinderance factor is formed in case of advancement of next 180°.

When the sound pressure is produced from production factors of sound, the law of inertia is applied for the movement of the cone(5) having advancement backing above and below, and such a principle should be made clear.

That is, the pressure of 1,013 mmBAR is three dimensionally formed between air molecule and air molecule in air. Namely, there is a unit(dimension) of volume between air molecules.

In case of advancement of the cone(5), the air molecule having constant mass is propagated vibration with 340 m/sec velocity to next air molecules. In the propagation procedure, when repeated regular wave motion of initial sound has advancement of 180° for the vibration of ½ the wave length between element particles of air, space between the particles initially becomes narrow and has buffer action(or cushioning).

And then the procedures which are propagated vibration from one element particle of air to next particle has continuously repeated. The force which is reached final point and propagated is very weak and sound is not audible. Sound could not be produced by only amount of air. Only when the air has pressure sound is produced.

In case of backing of the cone(5), only the volume of air particles is changed and sound pressure is not changed and maintained constantly.

Further, when the cone(5) is moved backward, if it has very fast movement of the cone(5), air is not correspondingly moved and air around the cone(5) becomes rare at one time.

For example, it is reduced with the same pressure to 999 mmBar. The element particle states have very large amplitude, but is formed at the pressure more several times than at the pressure in case of advancement of 180°.

In the vibration at the normal state the element particle state has only negligible approximation. When the cone(5) is moved backward this is very fast formed under the element particle state. Accordingly, when sound media is propagated with 340 m/sec velocity under 1,013 mmBAR pressure state, the sound is not sufficient in coming with filling rare space from the cone(5) and has very slow velocity.

That is, air backing velocity is more slow than fast vibration and next advancing cone(5) is formed lowering of sound pressure by air shortage, the sound pressure having advancement of 180° is interferenced.

Finally, fine sound is reproduced with sound as in fogging state of TV. Accordingly, when advancing sound pressure of the cone(5) is produced, backing cone(5) is separated and sound should be reproduced. By doing so, it becomes near base principle of sound.

The sound pressure starts from the pressure above atomsphere and is produced from the times to be stronger than average pressure between air molecules.

When the times are set, movement between front and back molecules starts. However, below the pressure(1,013 mmBAR), the volume movement is produced and movement of the sound pressure is not taken place.

The volume movement is not sound movement and the displacement of only air as at movement from this place to that place. Sound state of the sound pressure is not necessary in the procedure producing sound from the cone(5), and can be considered as a factor producing in the process of propagation of sound pressure wave.

That is, there is no sound media in vacuum state and sound is not audible. However, if air pressure is strong sound has tendency to become large.

Further, if the air pressure is rare(weak), strength of sound gets weaker.

As understood above description when the sound signal runs on the input terminal(13) the center pole yoke(1), plate(2) and magnet(3) are formed a magnetic circuit if produced magnetic field from the voice coil (2), and the cone(5) integrally formed with the voice coil(4) is vibrated. At this time, by vibration of the cone(5) change of sound pressure occurs and sound is produced. That is, when the cone(5) is in advancement of 180°, the sound pressure is produced. However, when in backward motion of 180°, element particle state of air is taken place and production of sound becomes impossible. When sound signal voltage is increased as (+) valtage, current running on the voice coil(4) also is increased the magnetic force is correspondingly increased and the core(5) is gradually moved above.

Accordingly, air is moved with above direction of the cone (5), and pushed out above. As a result of pushing out air, sound pressure is produced. However, from a very little exceeding range of 90° phase, the sound signal voltage is down. By such lowering voltage, current, magnetie force, and cone position are shown same wall forms, but the air movement dorection is shown opposite phenomenon against preceding 90° phase.

From above description, the air pressure is down along the down movement of the cone(5) and the air molecules are correspondingly down.

Inversely, when the sound signal voltage is increased as (−) voltage current, magnetic force and cone position also are increased by above described operation. However, the phase has apposite phase against (+) voltage.

From the moment which is a little exceeded 270°, only air movement direction has wave forms different from valtage wave forms. This reason is on air pushing out above by lowering and raising the cone (5).

FIGS. *2a* to *2f* are shown various waveforms relative to action characterisatcs for woofer, midrange and tweeter of the cone type speaker.

FIG. *2a* is shown a response curve of prior art speakers when an input signal is a sine wave pulse; FIG. *2b* is a response curve having square waveforms; FIG. *2c* is a response curve having sine wave which is alternately shown a pair of wave forms having only (+) phase in semi-cycle as an input signal, and a pair of waveforms having only (−) phase in another semicycle; and FIG. *2d* is a response curve having wave forms which one cycle of square wave comprises semicycle as (+) phase and another semicycle as (−) phase and is alternately produced.

Herein, different action characteristics for low sound, middle sound and high sound depend upon mass of means using in the corresponding woofer, midrange and tweeter.

FIG. *2e* is shown correlation with mass and response velocity. When mass becomes weighty, it can not follow the cone vibration by application for the law of inertia. Accordingly, the action characteristics are reduced.

This reason can be understood in FIG. *2a* to *2d*. consequently, very complete sound pressure is transmtted in the very light woofer, and the complete sound pressure is not transmitted in the very weighty tweeter.

Thus, mass of means relative to vibration in the speaker has a significant factor, and the mass of 0(zero) is very suitable and could not be realized.

Further, the mass is affected resonance frequency. FIG. *2e* is shown correlation with power and frequency. It is shown audio frequency 20 HZ-20 KHZ.

As shown in FIG. *2e*, low frequency band is distributed much current distinctly and proportionately more than high frequency band. When real sound pressure is produced, the sound pressure is interferenced by the speaker (woofer, midrange and tweeter) of each sound band and impaired.

FIG. *2f* is shown correlation which sound pressure and frequency. Said pressure is very strong in the range of frequency 2 KHZ-5KHZ and becomes more lower in the neighbors of low frequancy band 20 HZ or high frequency band 20 KHZ.

Accordingly, FIG. *2f* is shown shape of unaudible sound pressure below 0.0002 μBAR.

Above described prior art speaker driving system is transmitted sound pressure in the range of 20 HZ-20 KHZ and this prior art speaker has major defects with different sound pressure variance by frequency.

For example, the sound pressure is weakly produced in suitable sound pressure is produced only in the frequency band of 1 KHZ.

In the very high frequency or low frequency, only low sound is produced.

When the speaker is drived with low sound, abrupt descent is taken place in the low sound and hish sound.

Such falling or descent is on the grounds for reduction of cone driving range. Further, such discent is taken place because reduction sound is not produced in the high sound and low sound.

Accordingly, by compensating low band and high band as "loudness control", uses can hear. Additionally, the cone is moved by the law of inertia, and on the procedure of converting electric characteristics into mechanical vibration the cone starts lately when is driven, and stops a little afterward. When the vibrating cone becomes more weighty, it has harm and serious charactiristics. It does injury quality of sound.

Further, another problems relate to air resistance. When the core area become more larger, it receives air resistance and sound becomes dull.

By distortion phenomenon, when stiffness becomes more larger or smaller high band and low band are seriously affected.

Additionally, by various defects which are produced in the structures and action characteristics of conventional cone spakers, reproduction of original sound is impossible.

Therefore, it is an object of the present invention to provide a speaker system in which above listed prior art problems are over come; vibration of a vibrator to function conventional cone is not affected change of sound to enable reduction of original sound; interference phonomenon by doppler's effect is removed by forming integrally conventional frequency separation system with a vibrator; constant air pressure is maintained by disposing air tank separately; and mass of the vibrator is minimized and the law of inertia is not applied thereby sound is completely reproduced in any band.

BRIEF DESCRIPTION OF THE DRAWINGS

The present invention will be understood and appreciated morefully from the following detailed description, taken in conjunction with drawings in which.

FIG. *2a, 2b, 2c, 2d, 2e* and *2f* are wave form charts for operational characteristics of prior art speaker systems.

FIG. *3a* is an exploded perspective view of a cylinder implementing in accordance with the present invention.

FIG. *3b* is a sectional view of a speaker system of the present invention.

FIGS. *4a, 4b, 4c, 4d, 4e* and *4f* are wave form charts for operational characteristics of the speaker system according to the present invention.

DESCRIPTION OF THE PREFERRED EMBODIMENT

Figure 1:
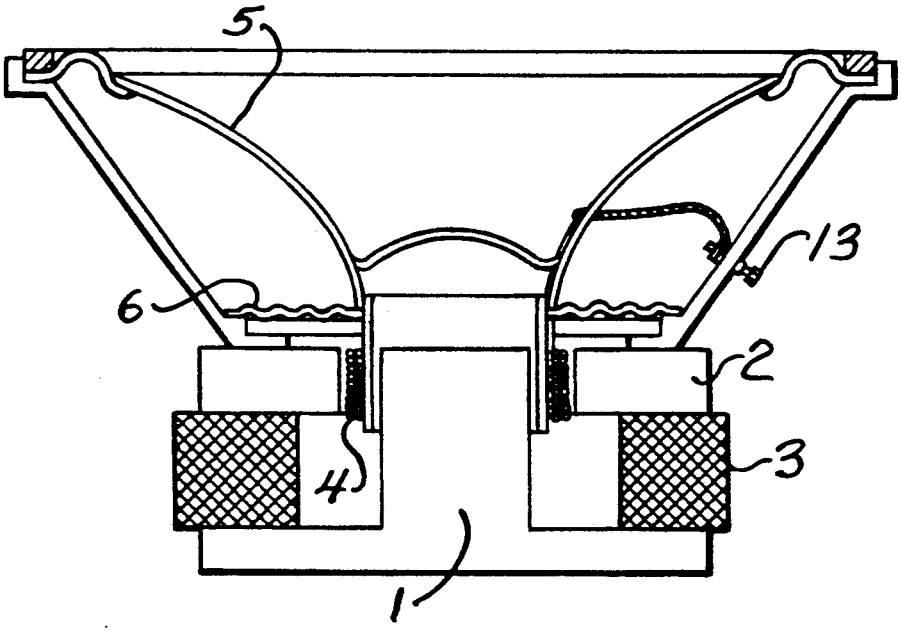
FIG. 1 PRIOR ART
FIG. 1 is a cross-sectional view of a general structure for a cone type speaker system.
Figure 2A:
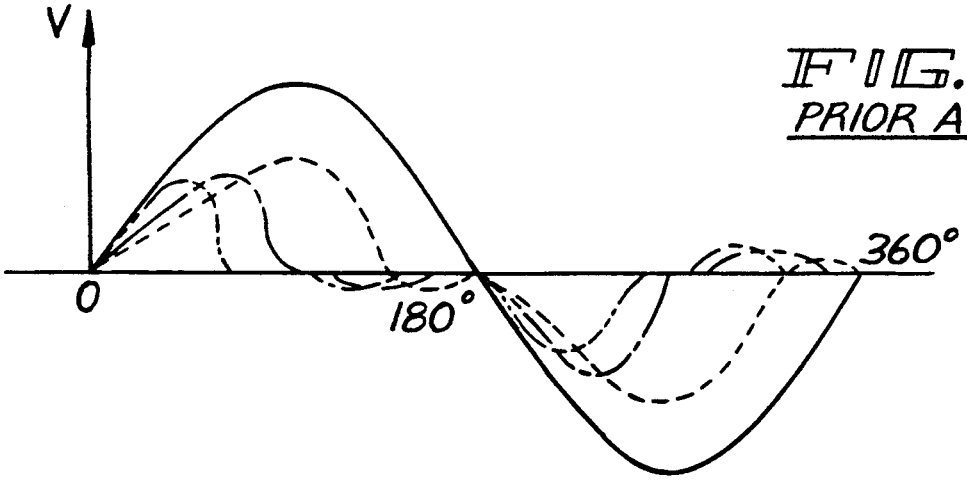
FIG. 2a PRIOR ART
Figure 2B:
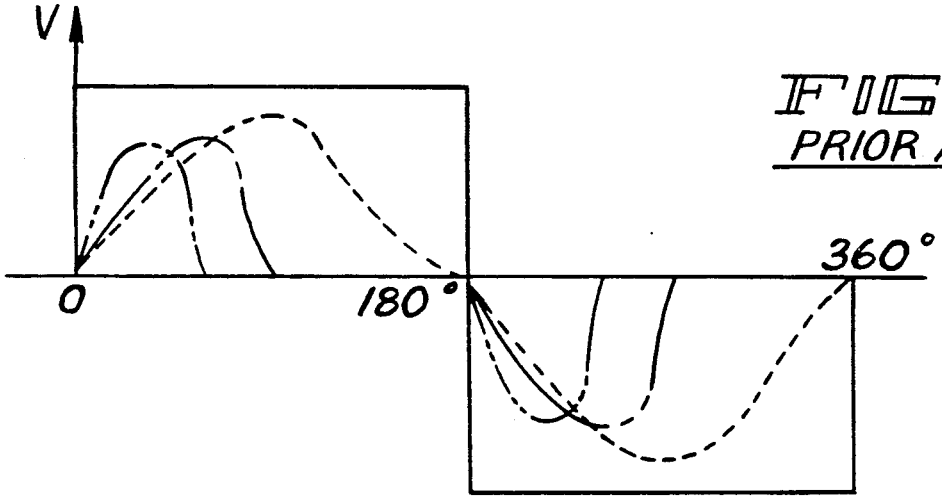
FIG. 2b PRIOR ART
Figure 2C:
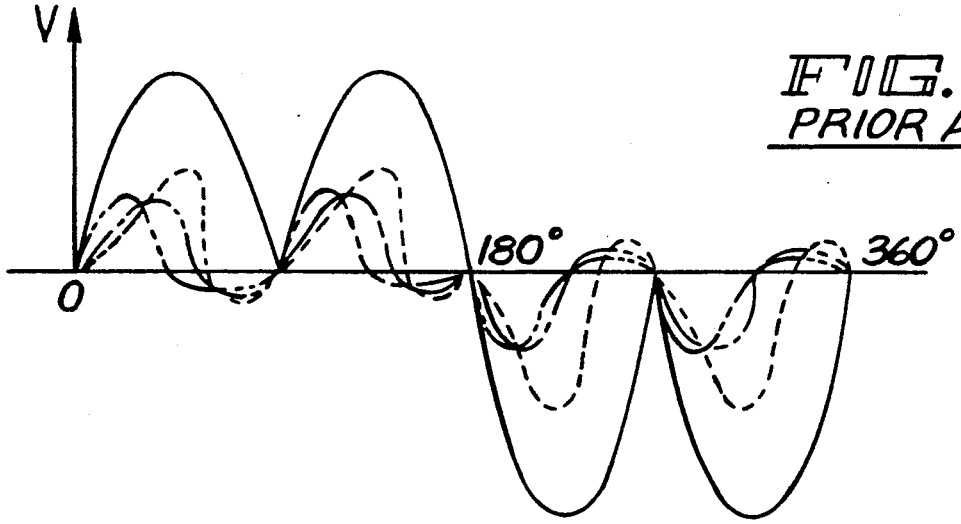
FIG. 2c PRIOR ART
Figure 2D:
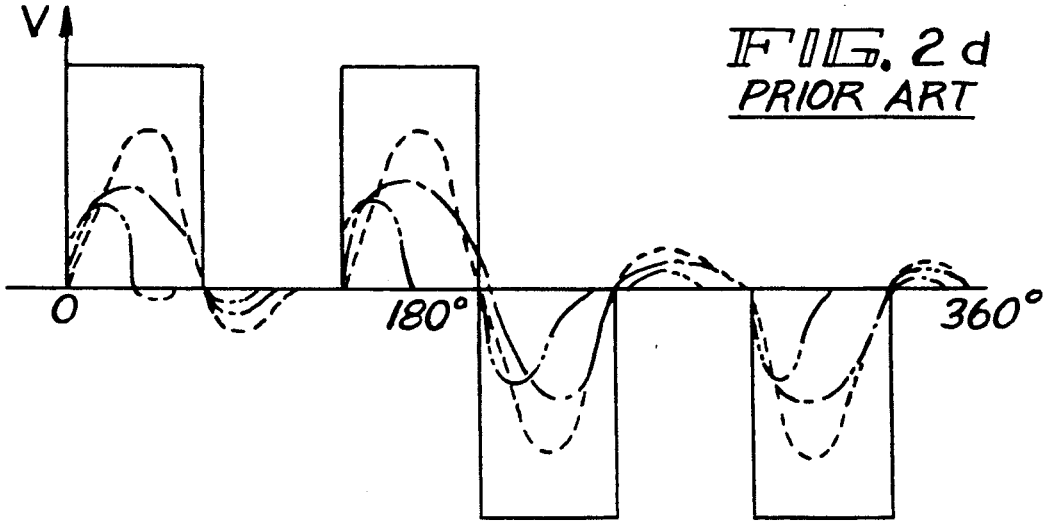
FIG. 2d PRIOR ART
Figure 2E:
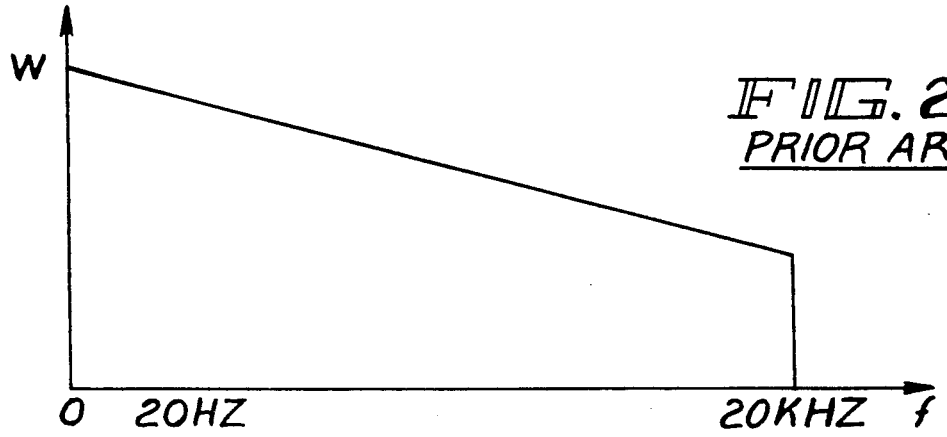
FIG. 2e PRIOR ART
Figure 2F:
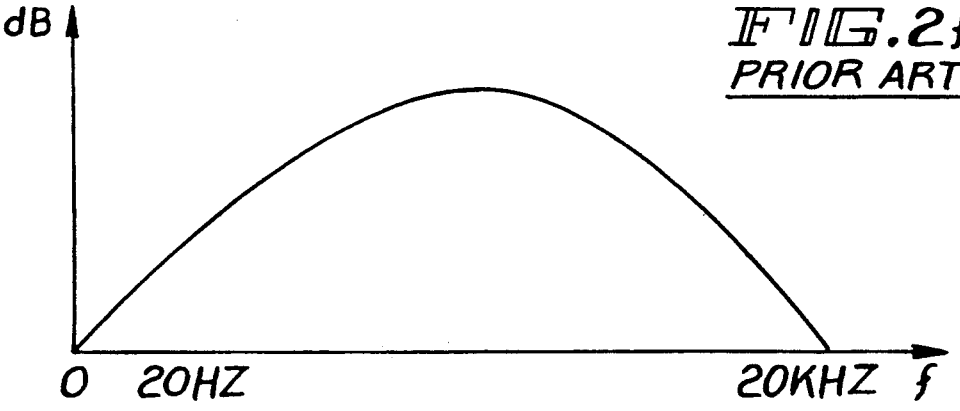
FIG. 2f PRIOR ART
Figure 3A:
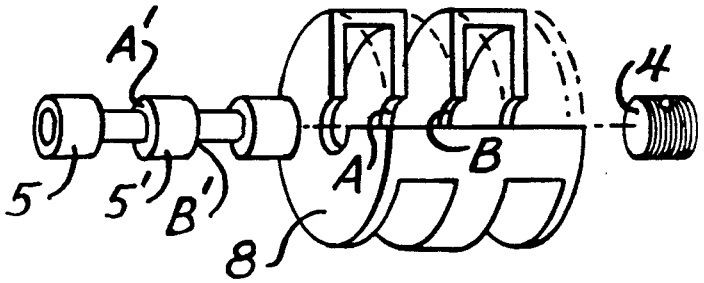
Figure 3B:
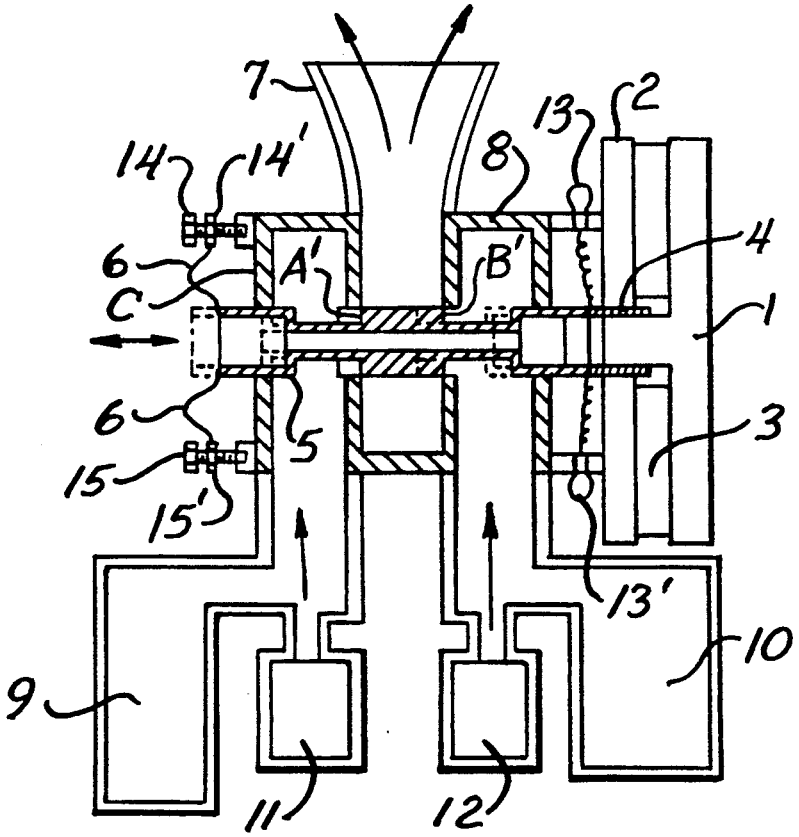

Referring more particularly to FIGS. 3*a* and 3*b*, FIG. 3*a* is shown a partially cut perspective view. Within a hollow part of a cylinder which has three chambers to be passed through above and below, a vibrator(5) is horizontally formed. Said vibrator(5) is hollowly formed. Further, as shown in FIG. 3*b*, a voice coil(4), which is received sound signal voltage from the outside through input terminals(13, 13'), is fixedly mounted on one side of said vibrator(5) and a magnetic circuit is formed from a center pole yoke(1), plate(2) and magnet(3).

By formation of the magneric circuit, wall surfaces-(A,B) of a cylinder (8) are switched upon displacement of left and right gates(A', B') of central outer conferential surface (5') for the vibrator(5).

As a result of switching, sound pressure is produced from a high pressure tank(9) or low pressure tank (10) prefilled by sources 11 and 12, respectively.

Air is controlled which is under the constant air pressure state through a horn(7) integrally disposed on a top central opening portion of the cylinder(8).

Further, when sound signal voltage has(+) voltage, the high pressure tank is operated. When sound signal voltage has (−) voltage, the low pressure tank is operated. The present invention is designed to have such operation.

The sound signal voltage is applied from the out side through the input terminals(13, 13') when the sound signal voltage is increased with (+) voltage current through the voice coil(4) also is correspondingly increased.

Thus, the corresponding magnetic force is produced, and the vibrator(5) is moved to the right side on the drawing by the voice coil(4), central pole yoke(1), plate(2) and magnet(3).

Accordingly, a door between inner wall surfaces (A, B) of the cylinder(8) is opened by movement of gate portions (A', B') of the vibrator(5) blocked wall surfaces(A,B) of the cylinder(8). At this time, in the moment of putting power source on the audio system, a pressure-controlled switch (not shown) is switched and a valve of the air pressure tank(9) is opened before the vibrator(5) is moved, and air is pre-filled in the cylinder(8).

This pre-filled air is transmited into the sound pressure by the horn(7) immediately when the door between wall surfaces (A, B) of the cylinder (8) is opened by movement of the vibrator(5).

Further, upon displacement of air movement, air amount is determined, and a damper(6), which is fixed with a pair of bolts(14,15) and (14', 15') mounted on a wall surface(C) of the cylinder (8), is integrally formed with the vibrator(5).

Damper (6) serves to hold the vibrator (5) in rest position as shown in FIG. 3*b*. Accordingly, movement of the dampers(6) is determined upon displacement of the vibrator(5).

Additionally, stiffness of the dampers is acted by force of the opposition direction in respect to movement direction of the damper. Accordingly, as described above, when the sound signal voltage is increased with(+) phase and then from moment exceeding 90° phase in some degree, the sound signal voltage is descended. Accordingly, current, magnetic force, vibrator position, movement direction of air, and air amount also start descending with the same phase.

Significant matter discribed herein is relative to movement direction of air. The speakers of conventional cone driving system are reversed with the opposition phase. However, in the speaker according to the invention, displacement of the vibrator(5) is not affected on the sound pressure, and constant air pressure from the air tanks(9, 10) is produced. Accordingly, air direction is constantly maintained, and sound signal can be reproduced.

When the sound signal voltage is increased with (−) phase, as described above, with above operation procedure, the voltage is increased with the same phase.

Here, at the moment which the phase of the sound signal voltage is exceeded 270°, the sound signal may be reproduced because it is different from the speaker of conventional cone driving system.

FIGS. 4*a*, 4*b*, 4*c*, 4*d*, 4*e* and 4*f* are shown wave form charts for operation characteristics according to the invention speaker. The wave forms shown with the solidline are base wave forms, and the wave forms shown with the dashed line are response wave forms relative to the base wave form from the inventive speaker.

Figure 4A:
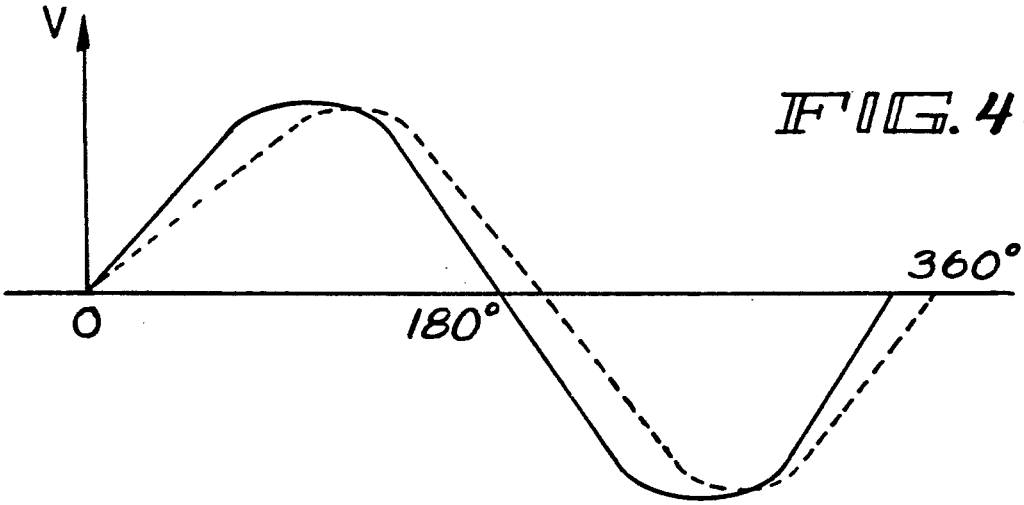
Figure 4B:
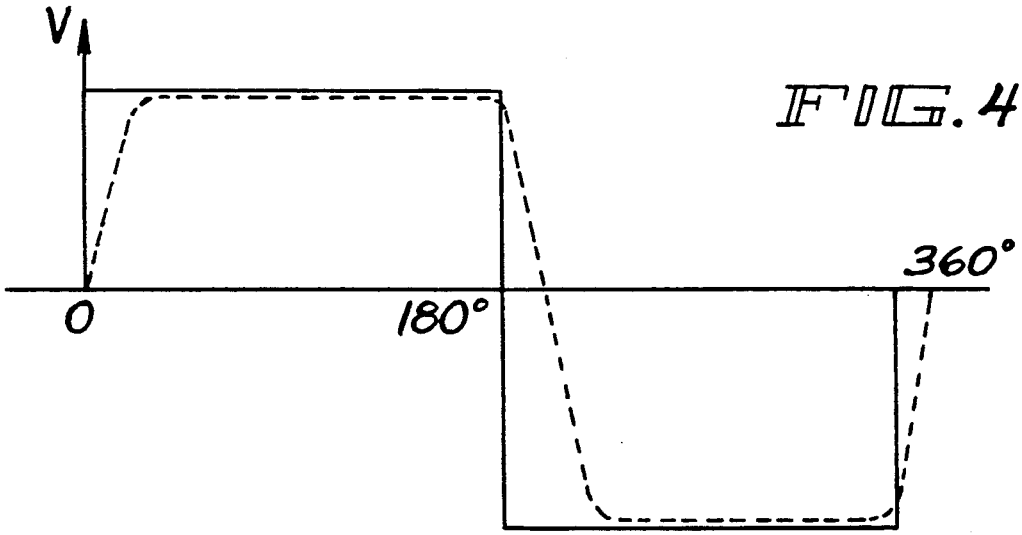
Figure 4C:
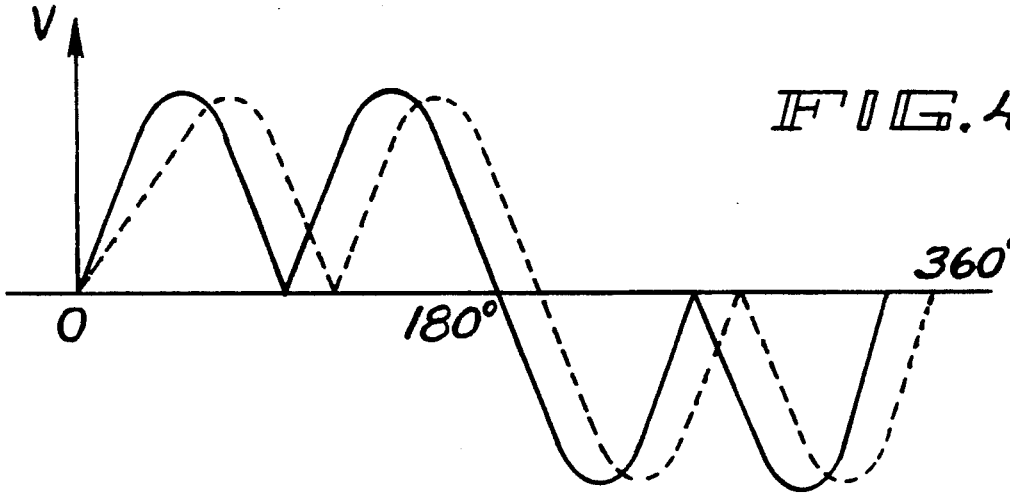
Figure 4D:
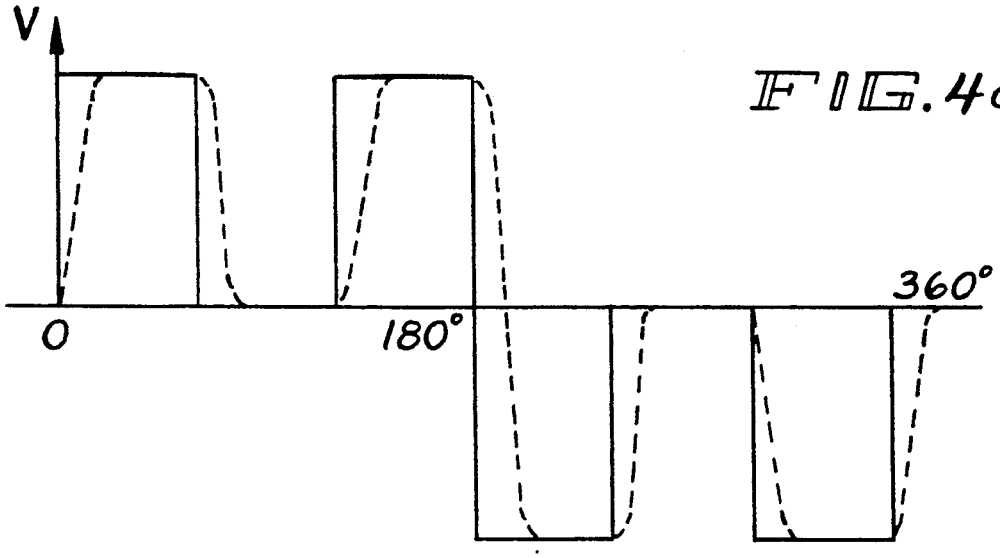

FIG. 4*a* is shown a response curve when the sound signal voltage forms sine wave pulse. FIG. 4*b* is shown shape of square wave pulse. FIG. 4*c* is shown sine wave which is alternately illustrated a pair of wave forms having only (+) phase in semicycle as an input signal and a pair of wave forms having only (−) phase in another cycle. FIG. 4*d* is shown a response curve which one cycle of a square wave is formed a semicycle as only (+) phase and another semicycle is formed one cycle of a square wave as only (−) phase and they are alternately produced.

Figure 4E:
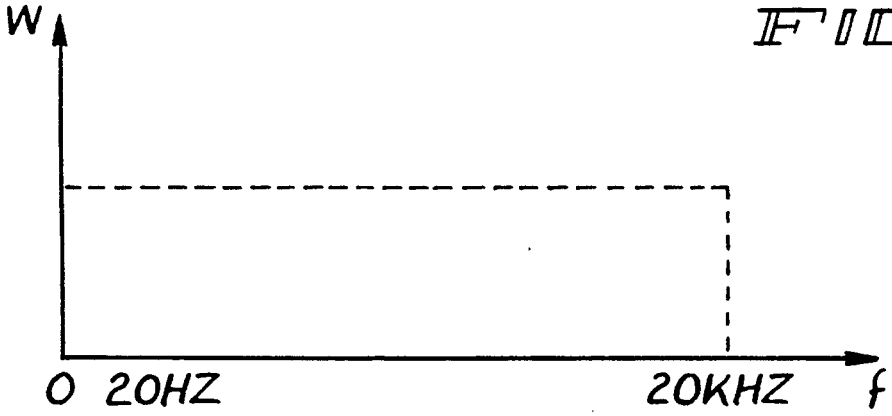
Figure 4F:
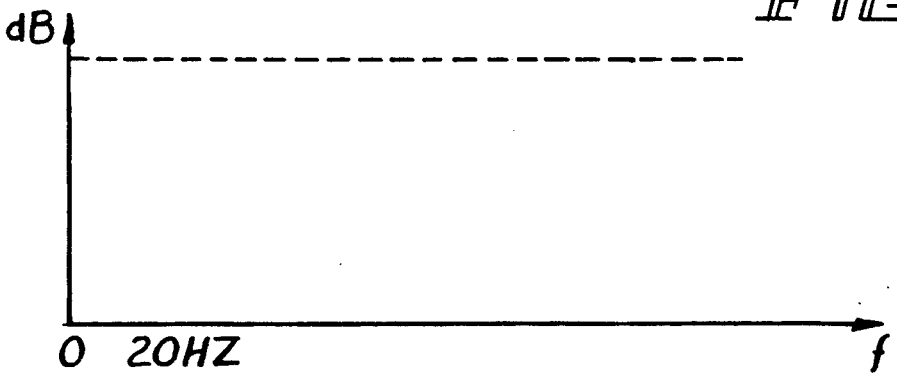

FIGS. 4*e* and 4*f* are shown correlation for power vs. frequency and sound pressure vs. frequency, respectively, and they are distinctly different, comparing the invention with prior art.

That is, in the speaker of the conventional cone driving system the power and sound pressure are different by the frequency. However, in the invention speaker, the power and sound pressure are constantly maintained regardless of the frequency.

Accordingly, the invention is different from the existing system of the speaker and can not be selected the dividing system and sound may be reproduced.

Further, another speaker system according to the invention has lighter weight (for example, 0.4–0.5 g) than that of the means comprising the speaker of conventional cone driving system (for example, 40 g). Accordingly, the invention is advantageous because approximate 1/100 may be reduced according to the law of inertia.

Additionly, when sound signal voltage is put through the input terminals (13, 13') as an phase signal, current is run on the voice coil (4) and magnetic force is produced by the magnetic circuit comprising the central pole yoke(1), plate(2), and magnet (3) in contrast with the application time of (+) phase signal voltage.

Then, the vibrator(5) is moved on the right side, and the door between the inner walls(A, B) of the cylinder (8) is opened.

Accordingly, the atmospheric pressure is run into the low pressure tank(10) through the horn(7). This is the same to the backing time of conventional cone driving system, and in above system element particle state may be formed in backing time. However, in the speaker according to the present invention air under the constant air pressure is filled by the low pressure tank (10) and such element particle may not be produced.

Accordingly, in summarizing operation principle of the invention, as shown in FIGS. 4*a* to 4*f* it is understood that various wave forms may be produced. Their forms are distinctly different from the prior art.

When the vibrator(5) is moved, friction against the cylinder (8) by the pre-filled air is not great. The friction force is constant regardless of change of the air pressure because the filled air is pressed constant force against the vibrator(5).

Futher, the vibrator(5) is vibrated against the entire surface of the damper (6) within the fixed distance.

Effects controlling inteference of sound pressure which is produced in the speaker different from the conventional cone driving system, and doppler's effect may be taken.

Various modifications of-the speaker system of the invention may be made without departing from the spirit or scope thereof and it is to be understood that the invention is intended to be limited only as defined in the appended claims.

What is claimed is:

1. A speaker system comprising a longitudinal closed hollow cylinder having three chambers formed by two spaced walls, a longitudinal bore passing through said cylinder, a longitudinal cylindrical vibrator movably disposed in said bore, said vibrator having three spaced enlarged portions, the central portion defining a middle gate engageable with a central chamber formed by said spaced walls and coupled to a sound rendering horn, a high air pressure tank coupled to one outer chamber and a low air pressure tank coupled to another outer chamber of said three chambers, said middle gate on said vibrator adapted to move in either direction with respect to said central chamber to couple air pressure from either of said tanks to said central chamber and said horn, a yoked magnet, a plate and a voice coil adjacent one end of said vibrator for developing a magnetic circuit to move said vibrator with respect to said horn.

2. A speaker system according to claim 1, wherein said high pressure tank is provided with a constant high air pressure which is applied to the left side of said central chamber when a sound signal voltage (+) is applied to the voice coil and said low pressure tank is provided with a constant low air pressure which is applied to the right side of said central chamber when a sound signal voltage (−) is applied to the voice coil.

3. The speaker system of claim 1, wherein said vibrator is hollow in order to minimize mass and facilitate passage of air.

4. The speaker system according to claim 1, wherein the end of the vibrator, opposite to the end with the voice coil, is provided with a damper mounted on a wall of the cylinder.

* * * * *